US011312558B1

(12) United States Patent
Moore

(10) Patent No.: US 11,312,558 B1
(45) Date of Patent: Apr. 26, 2022

(54) MULTI-POINT LOAD TUB SUPPORT

(71) Applicant: Sonoco Development, Inc., Hartsville, SC (US)

(72) Inventor: Clifton Moore, Murfreesboro, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 17/152,325

(22) Filed: Jan. 19, 2021

(51) Int. Cl.
*B65D 85/68* (2006.01)
*B65D 81/127* (2006.01)

(52) U.S. Cl.
CPC ..... *B65D 81/127* (2013.01); *B65D 85/68* (2013.01); *B65D 2581/053* (2013.01); *B65D 2585/6855* (2013.01)

(58) Field of Classification Search
CPC ..... B65D 81/127; B65D 85/68; B65D 2581/053; B65D 2585/6855
USPC ..... 206/320, 592, 593, 594
See application file for complete search history.

(56) References Cited

U.S. PATENT DOCUMENTS 1,497,661 A 6/1924 Scotcher
2,961,141 A 11/1960 Lukes
3,896,930 A * 7/1975 Collin ..... D06F 39/001 206/320
3,901,385 A * 8/1975 Rosen ..... D06F 39/001 206/320
3,904,039 A * 9/1975 Anyon ..... D06F 39/001 206/320
3,912,076 A * 10/1975 Elwell ..... D06F 39/001 206/320
4,700,832 A * 10/1987 Champ ..... D06F 39/001 206/370
4,832,190 A * 5/1989 Favreau ..... B65D 85/68 206/320
9,670,611 B2 6/2017 Senn et al.
9,790,634 B2 10/2017 Senn et al.
2008/0168803 A1 7/2008 Muyskens
2008/0264806 A1* 10/2008 Trebilcock ..... D06F 39/001 206/207
2015/0122680 A1* 5/2015 Kim ..... D06F 39/001 206/320
2017/0183805 A1* 6/2017 Senn ..... D06F 39/00
2021/0139230 A1* 5/2021 Bischoff ..... D06F 39/001

* cited by examiner

*Primary Examiner* — Jacob K Ackun
(74) *Attorney, Agent, or Firm* — von Briesen & Roper, s.c.

(57) ABSTRACT

A tub support that fits inside the top opening of a washing machine to prevent the wash tub from moving relative to the cabinet during shipping and handling, and a blank for making a tub support. The tub support may comprise a rear folded portion having a plurality of rear tub contact points that contact the wash tub, and a sidewall configured to contact the top edge of the wash tub along a plurality of tub contact points and to contact the rim of the washing machine cabinet along a plurality of cabinet contact points.

15 Claims, 7 Drawing Sheets

MULTI-POINT LOAD TUB SUPPORT

BACKGROUND OF THE INVENTION

Field of the Invention

This disclosure relates to the field of appliance packaging. More particularly, this disclosure relates to a device that fits inside a top opening of a washing machine to prevent the wash tub from moving relative to the outer cabinet during shipping and handling.

Description of the Related Art

Top-loading washing machines generally comprise a spin or wash tub disposed within a washing machine cabinet or housing. The tubs and transmissions of some washing machines are mounted to the bottom plate of the structure. A more common design includes the tub and transmission supported from suspension rods mounted on the underside of the washing machine top surface. Machines with the hung suspension mounting systems must be packaged in a way to prevent the tub/transmission assembly from moving (both laterally and vertically) during shipment. Both washing machine designs may or may not use a central agitator.

In either type of washing machine, the clearance between the tub and the cabinet is often no more than an inch (2.54 cm). As a consequence, unsecured tub/transmission assemblies can cause outward dents in the machine cabinet during product distribution.

Thus, there is a need for a device that locks the tub in place or otherwise prevents the tub from impacting the cabinet when the washing machine is moved. And in washing machines having a D-shaped top opening, the device must be able to fit within the D-shaped opening.

The present disclosure is designed to solve the problems described above.

BRIEF SUMMARY OF THE INVENTION

The present disclosure relates to a tub support that fits inside the top opening of a washing machine to prevent the wash tub from moving relative to the cabinet during shipping and handling, and a blank for making a tub support.

In an embodiment, the blank comprises a bottom panel, a plurality of bottom flaps and a plurality of side flap assemblies. The bottom panel has a perimeter. Each bottom flap is attached to the perimeter of the bottom panel along a corresponding fold line and is configured to fold over onto the bottom panel in flat facing abutment therewith. Each side flap assembly is configured to extend upward from the perimeter. The side flap assemblies are interconnected with each other to form a continuous sidewall.

In another aspect a tub support is described that includes a bottom panel, a continuous sidewall and a rear folded portion. The tub support may be used with a washing machine of a type having a wash tub located within a cabinet, the wash tub having a top edge, the cabinet having a top surface having a rim defining a top opening, the rim comprising a semicircular front portion and a rear portion, the tub support being made from a single, folded blank. The bottom panel has a perimeter and comprises a rear portion. The continuous sidewall extends upward from the bottom panel and above the semicircular front portion of the rim, and is configured to contact both the wash tub and the cabinet. The rear folded portion comprises a plurality of bottom flaps folded onto the rear portion of the bottom panel. The rear folded portion is configured to extend under the rear portion of the rim.

In a refinement, the rear folded portion comprises two rear tub contact points that contact the wash tub. The sidewall is configured to contact the top edge of the wash tub along a plurality of tub contact points and to contact the rim of the cabinet along a plurality of cabinet contact points.

In still another aspect another tub support is described that includes a bottom panel, a continuous sidewall and a rear folded portion. The bottom panel has a perimeter and comprises a rear portion. The continuous sidewall is formed by interconnected side flaps and extends around part of the perimeter, upward and outward from the bottom panel at an included angle of greater than 90 degrees. The sidewall is configured to contact both the top edge of the wash tub and the semicircular front portion of the cabinet rim. The rear folded portion comprises a plurality of bottom flaps in flat facing abutment with a rear portion of the bottom panel. The rear folded portion is configured to extend under the rear portion of the rim and contact the wash tub at a plurality of rear tub contact points.

In a refinement, the rear folded portion comprises two rear tub contact points that contact the wash tub, and the sidewall is configured to contact the top edge of the wash tub along a plurality of tub contact points and to contact the rim of the cabinet along a plurality of cabinet contact points.

In another refinement, in the alternative tub support, some or all of the side flaps comprise a locking tab extending from an inner panel and inserted into a corresponding slot defined by the bottom panel.

DETAILED DESCRIPTION OF THE INVENTION

Figure 1:
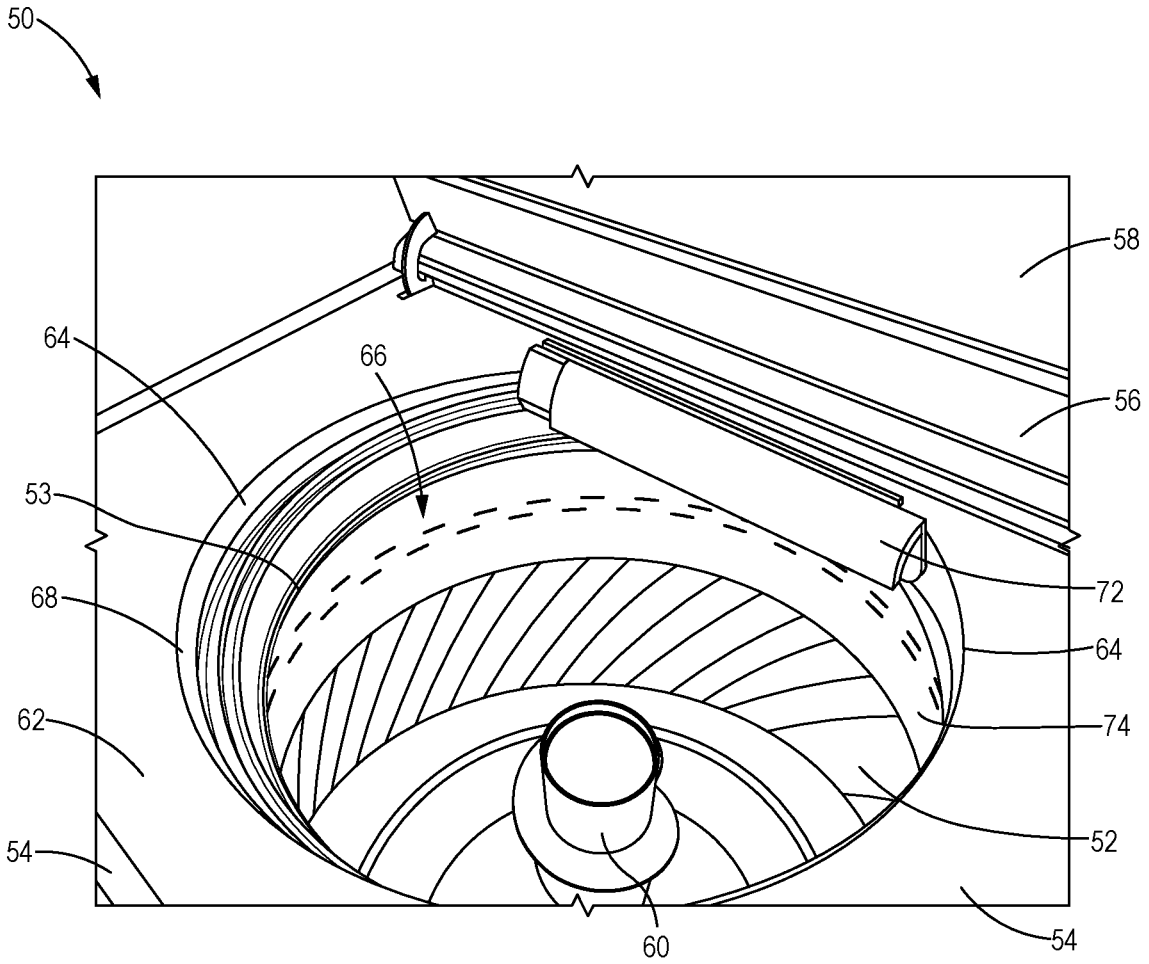
FIG. 1 is a top perspective view of a washing machine.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "above" and "below", "upper" and "lower", "vertical" and "horizontal", "top" and "bottom," "front" and "back," (etc.), used as nouns, adjectives or adverbs refer in this description to the orientation of the structure and orientation of the tub support as it is illustrated in the various views. Such terms are not intended to limit the invention to a particular orientation.

Turning to the drawings, where like numerals indicate like elements, there is shown in FIG. 1 a partial perspective view of a top loading washing machine 50. The washing machine 50 comprises a wash tub 52, a cabinet 54, a lid 56 hingedly attached to the cabinet 54 or to a structural frame (not shown) inside the cabinet, and a control panel 58 extending upward from a rear of the cabinet 54. In the figure, the washing machine 50 has a central agitator 60.

The wash tub 52 is located within the cabinet 54 and may be suspended from the cabinet 54 or from the structural frame inside the cabinet 54. The wash tub 52 can swing or otherwise move from its center position and impact the walls of the cabinet 54 from the inside if not restrained. These impacts can produce a cosmetic defect to the outside of the cabinet 54.

The cabinet 54 has a top surface 62 that extends inwardly from the sides of the cabinet to a rim 64 that defines a top opening 66. The rim 64 may be D-shaped and may comprise a semicircular front portion 68 and a rear portion 70 that may be relatively straight. The front portion 68 may have a diameter (D1). Alternatively, or in addition to the relatively straight rear portion described above, the washing machine 50 may include a reservoir 72 for holding and dispensing softener or another component. The reservoir 72 may be mounted to the cabinet 54 below the control panel 58 so that the reservoir 72 extends over a rear portion of the top opening 66. The reservoir 72 typically is shaped like a straight cylinder, and so creates or adds to the D-shape of the top opening 66. In any case, whether due to the configuration of the rim 64 or the existence of the reservoir 72, for the purpose of this disclosure, the washing machine top opening 66 is D-shaped.

As noted above, a device is needed that fits inside the top opening 66 to prevent the wash tub 52 from moving relative to the cabinet 54 during shipping and handling. A tub support 40 has been designed to meet these needs.

Blank 10

Figure 2:
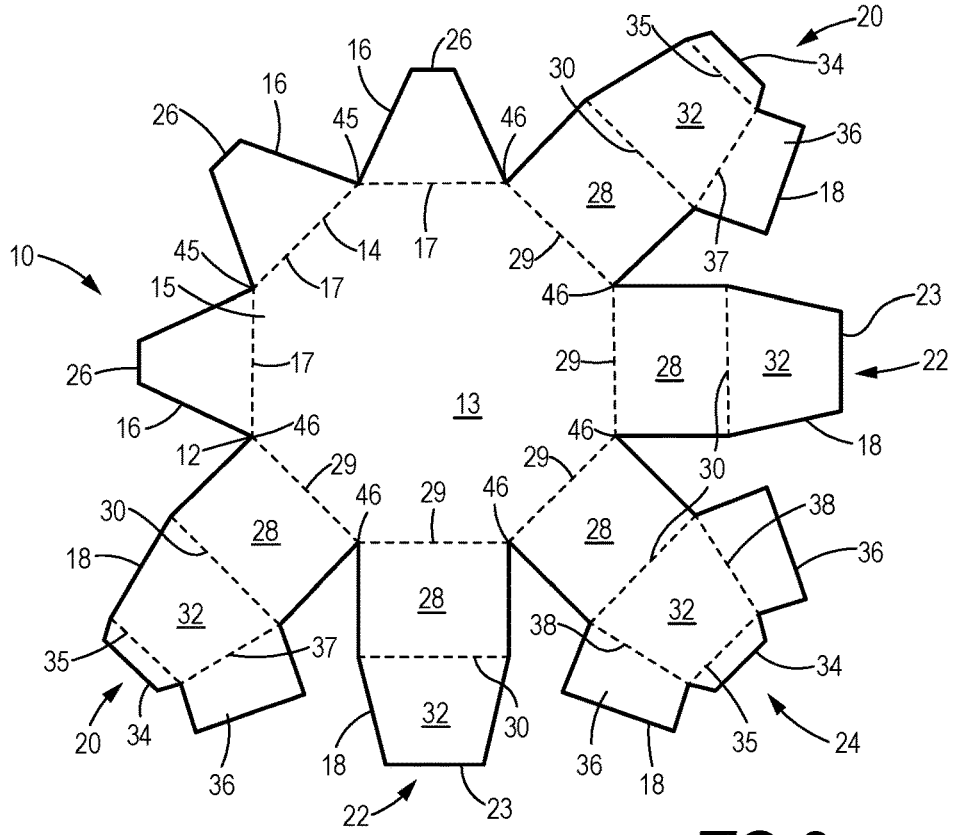
FIG. 2 is a top plan view of a blank for making a tub support according to the present disclosure.

FIG. 2 is a top view of one embodiment of a unitary (one piece) blank 10 for making a tub support 40 that can be used to prevent a wash tub 52 from moving relative to a cabinet 54 during shipping and handling. The blank 10 is preferably made of corrugated board that is cut, folded and preferably glued into a three-dimensional shape that fits within the D-shaped top opening 66 of the wash tub 52 and contacts both the wash tub 52 and the cabinet 54 at multiple points to prevent the wash tub 52 from moving relative to the outer cabinet 54 during shipping and handling.

In the embodiment of FIG. 2, the blank 10 comprises a bottom panel 12 having an eight-sided perimeter 14, three bottom flaps 16 and five side flap assemblies 18. The five side flap assemblies 18 comprise two first side flaps 20, two second side flaps 22 and a single third side flap 24. The perimeter 14 preferably has a perimeter diameter less than the front diameter (D1) of the front portion 68, and comprises eight segments (defined by first fold lines 17 and second fold lines 29), two rear tub contact points 45 located on either side of the middle bottom flap 16 where the first fold lines 17 meet, and six front apexes 46 where the remaining first fold lines 17 and the second fold lines 29 meet.

The bottom panel 12 may comprise a rear portion 15 which fits partly or entirely under the top surface 62 nearest the control panel 58 and thus at the rear of the machine 50.

Each bottom flap 16, so-called because it is folded over and preferably adhered to the bottom panel 12 in the assembled tub support 40, is foldably attached to the bottom panel 12 along a first fold line 17. Each bottom flap 16 may be any suitable shape, including trapezoidal shaped, for example, having a free distal edge 26 that is shorter than but parallel to its corresponding first fold line 17. This shape allows the bottom flaps 16 to be folded over onto the upper surface 13 (top facing surface) of the bottom panel 12 without overlapping, as perhaps best shown in FIG. 3.

Each of the five side flap assemblies 18 comprises, at a minimum, an outer panel 28 foldably attached to the bottom panel 12 along a corresponding second fold line 29. Each outer panel 28 may be any suitable shape, including rectangular shaped, for example having a distal edge or third fold line 30 that is parallel to the corresponding second fold line 29. Each side flap assembly 18 may further comprise an inner panel 32 rotatably connected to the outer panel 28 along the third fold line 30.

With respect to the two first side flaps 20 and the one third side flap 24, each may further comprise a fastening tab 34 extending from and foldably attached to the inner panel 32 by a fourth fold line 35. The bottom tab 34 is configured to adhere to the bottom panel 12 in the assembled tub support 40. Each first side flap 20 may further comprise a side tab 36 extending from a forward side fold line 37 for securing the first side flap 20 to an adjacent second side flap 22. Similarly, the third side flap 24 may further comprise two side tabs 36, one extending from each side fold line 38, for securing the third side flap 24 to two adjacent second side flaps 22.

With respect to the two second side flaps 22, each is positioned around the perimeter 14 between a first side flap 20 and the third side flap 24. Each second side flap 22 may comprise a free distal edge 23 parallel to a corresponding second fold line 29 and a corresponding third fold line 30.

It should be understood that the number, configuration and arrangement of the side flap assemblies 18 around the perimeter 14 can vary from that described above and still be in keeping with the scope and objective of this disclosure. For example, it is contemplated that the fastening tabs 34 could extend from the second side flaps 22 as well as or instead of the first and third side flaps 20, 24.

Tub Support 40

Figure 3:
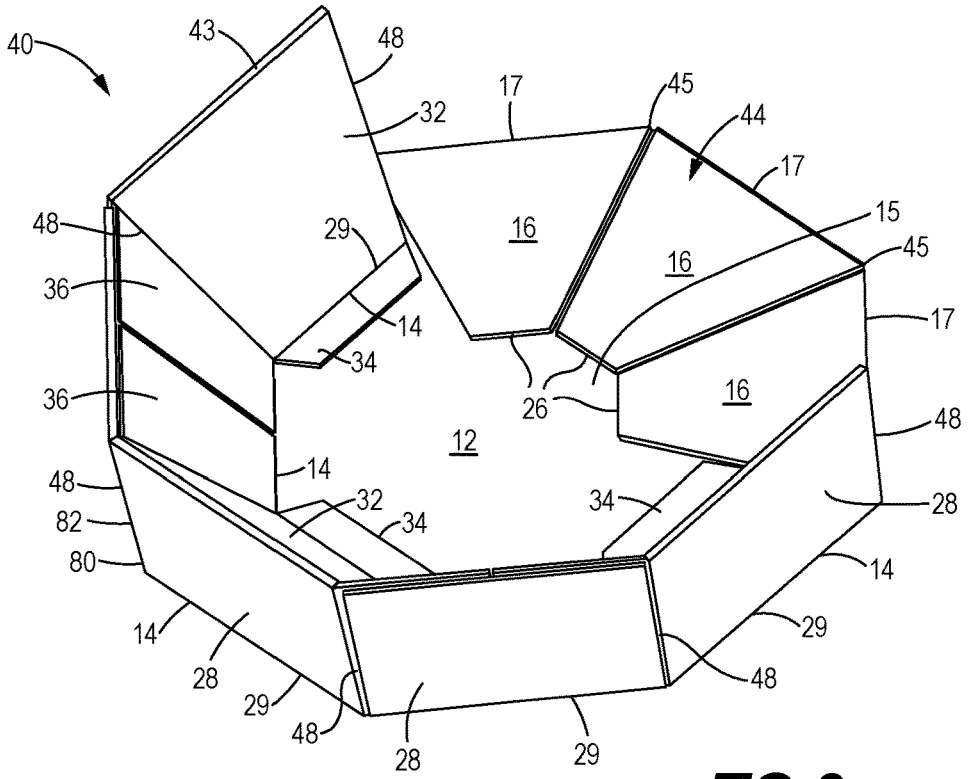
FIG. 3 is a top perspective view of a tub support made from the blank of FIG. 2.

FIG. 3 is a perspective view of an assembled tub support 40. The tub support comprises a five-sided continuous sidewall 42 and a rear folded portion 44. The sidewall 42 is formed by the interconnected side flaps 20, 22, 24 and preferably extends between about 180 degrees and about 225 degrees around the bottom panel 12. The rear folded portion 44 is two layers thick and is formed by the three bottom flaps 16 and the rear portion 15 of the bottom panel 12, wherein each bottom flap 16 is in flat facing abutment with (lying flat against) the rear portion 15.

The eight-sided (octagonal) shape is considered optimal because this shape is best suited for holding the wash tub 52 stationary with respect to the cabinet 54 as explained below. Other configurations are contemplated, including hexagonal and heptagonal shapes.

The tub support 40 comprises two rear tub contact points 45 where the first fold lines meet. The tub support also comprises six vertical edges 48 extending from the perimeter 14 of the bottom panel 12 to the five-segment top edge 43 of the sidewall 42. The function of these features is described below.

Method of Assembly

The tub support 40 may be assembled from a single blank 10 that is folded and glued as follows.

Bottom Flaps 16

Fold or rotate each bottom flap 16 upwards/inwards 180 degrees about the first fold line 17 until the bottom flap 16 is in flat facing abutment with the upper surface 13 of the bottom panel 12. Preferably, apply adhesive to the bottom flap 16 and/or the bottom panel 12 before the rotation so that each bottom flap 16 is adhered to the bottom panel 12.

First Side Flaps 20

Fold or rotate each of the two first side flaps 20 upwards/inwards about 80 degrees or so about its corresponding second fold line 29 so that the first side flap 20 extends upwardly at an included angle (a) of about 110 degrees from the bottom panel 12. The included angle should be preferably more than 90 degrees and less than 120 degrees.

Fold or rotate each bottom tab 34 backward/outward, away from the center of the tub support 40 so that it is in position to contact the bottom panel 12 when the inner panel 32 is further rotated.

Fold or rotate each side tab 36 slightly backward (about 30-45 degrees) so that the side tab 36 is in position to be secured to or captured within an adjacent second side flap 22 when the inner panel 32 is further rotated.

Further rotate the inner panel 32 of each first side flap 20 about the third fold line until the fourth fold line 35 contacts the bottom panel 12 and the bottom tab 34 is in flat facing abutment with the bottom panel 12 and preferably adhered thereto.

After the inner panel rotation step, the side tab 36 of each first side flap 20 should extend from the inner panel 32 at an angle that will allow the side tab 36 to be adhered to the adjacent second side flap 22 or captured between the inner panel 32 and the outer panel 28 of the adjacent second side flap 22. Also, the inner panel 32 and the outer panel 28 may be spaced apart to form a wedge shape. Alternatively, the inner panel 32 may be in flat facing abutment with the outer panel 28 to form a two-layer planar structure.

Third Side Flap 24

Similarly, fold or rotate the third side flap 24 about the second fold line 29 so that the third side flap 24 extends upwardly at an included angle (a) of about 110 degrees from the bottom panel 12. The included angle should be less than 120 degrees and preferably more than 90 degrees.

Fold or rotate the bottom tab 34 of the third side flap 24 backward/outward, away from the center of the tub support 40, so that it is in position to contact the bottom panel 12 when the inner panel 32 of the third side flap 24 is further rotated.

Fold or rotate both side tabs 36 slightly backward (about 30-45 degrees) so that each side flap 34 is in position to be adhered to or captured within an adjacent second side flap 22 when the inner panel 32 is further rotated.

Further rotate the inner panel 32 of the third side flap 24 about the third fold line until the fourth fold line 35 contacts the bottom panel 12 and the bottom tab 34 is in flat facing abutment with the bottom panel 12 and preferably adhered thereto.

Again, after the inner panel rotating step, the side tabs 36 should extend from the inner panel 32 at an angle that will allow each side tab 36 to adhered to the inner panel 32 or captured between the inner panel 32 and the outer panel 28 of the adjacent second side flap 22. Also, the inner panel 32 and the outer panel 28 may be spaced apart to form a wedge shape, or they may be in flat facing abutment with each other.

Second Side Flaps 22

Next, rotate each of the two second side flaps 22 about its second fold line 29 so that the second side flap 22 extends upwardly at an included angle (a) of about 110 degrees or so from the bottom panel 12.

Further rotate the inner panel 32 about the third fold line 30 until the free distal edge 23 contacts the bottom panel 12.

After this further rotation step, secure with adhesive or other means the side tab 36 from the adjacent first side flap 20 and the side tab 36 from the adjacent third side flap 24 to the inner facing surface of the inner panel 32 as shown in FIG. 3. Alternatively, the side tabs 36 of the adjacent side flaps 20, 24 may be captured between the inner panel 32 and the outer panel 28 of the adjacent side assemblies 18.

In the assembled tub support 40, the side flaps 20, 22, 24 are interconnected to form a five-sided continuous sidewall 42 having six vertical edges 48, each vertical edge 48 incorporating a wash tub contact point 80 and a cabinet contact point 82. The six wash tub contact points 80 preferably are circumferentially disposed about the tub support and lie within a first plane. Likewise, the six cabinet contact points 82 preferably are circumferentially disposed about the tub support 40 and lie within a second plane located above the first plane. The bottom flaps 16 and the rear portion 15 of the bottom panel 12 form a rear folded portion 44 that includes two rear tub contact points 45.

It should be understood that the order of the assembly steps can vary from that described above and still be in keeping with the scope and objective of this disclosure. For example, it is contemplated that the second side flaps 22 can be assembled before the first side flaps 20 and/or third side flap 24.

Installation

The tub support 40 may be installed as follows.

Figure 4:
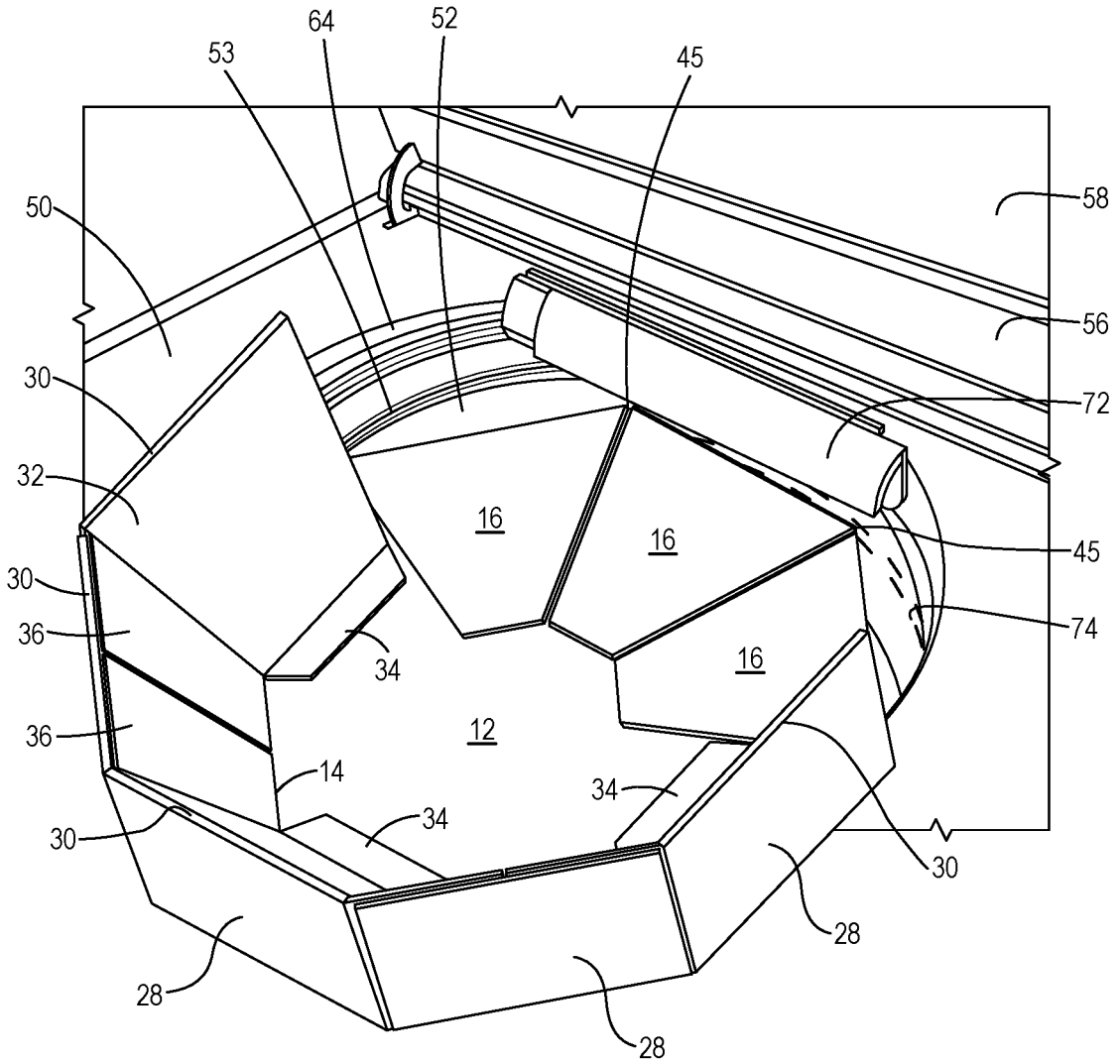
FIG. 4 is a top perspective view of the tub support of FIG. 3 partially installed in a washing machine.

As shown in FIG. 4, lower or insert the assembled tub support 40 into the top opening 66 of a washing machine 50 so that the rear folded portion 44 extends toward the rear of the top opening 66.

Optionally, tilt the tub support 40 so that the rear folded portion 44 can be inserted under the rear of the top opening 66 and/or any reservoir 72.

Further insert the tub support 40 into the top opening 66 until the tub support engages both the rim 64 and the wash tub 52. The tub support 40 should be inserted far enough into the top opening 66 of the washing machine 50 so that the lid 56 can be completely closed.

In the installed position, the tub support 40 should contact both the wash tub 52 and the cabinet 54 at multiple points to prevent the wash tub 52 from moving relative to the outer cabinet 54 during shipping and handling. More specifically, the two rear tub contact points 45 and the six wash tub contact point 80 should contact the wash tub 52 while the six cabinet contact points 82 should contact the cabinet rim 64.

Industrial Applicability

Figure 5:
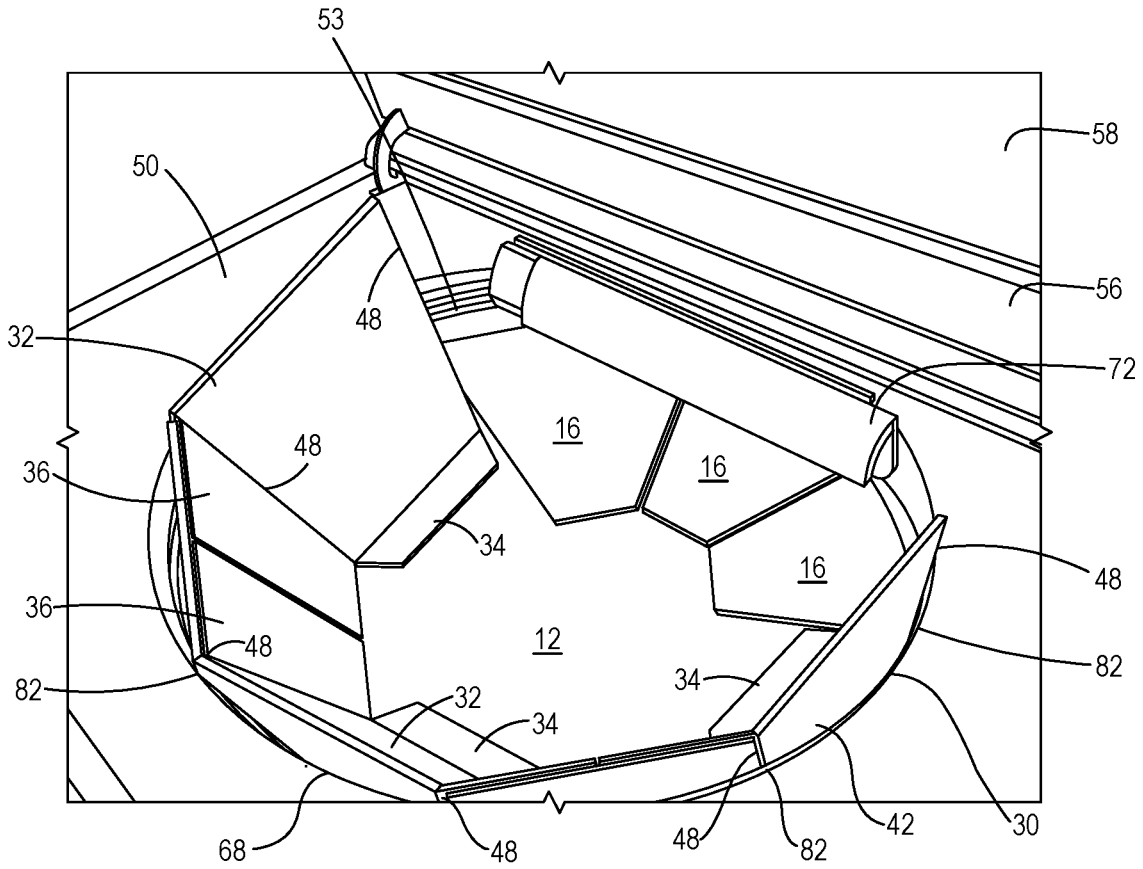
FIG. 5 is a top perspective view of the tub support of FIG. 3 installed in a washing machine.

FIG. 5 is a top perspective view of the tub support 40 of FIG. 3 fully installed in a washing machine 50.

In this fully installed configuration, the rear folded portion 44 of the tub support 40 extends at least partially under the straight rear portion of the rim 64—if there is one—and/or the reservoir 72. The rear folded portion 44, and this the tub support 40, contacts the interior wall 74 of the wash tub 52 at the two rear tub contact points 45.

The five-sided continuous sidewall 42 extends from below the top edge 53 of the wash tub 52 to above the semicircular front portion 68 of the rim 64. The sidewall 42 contacts the top edge 53 of the wash tub 52 along six tub contact points 80 (obscured in FIG. 5) and also contacts the rim 64 of the cabinet 54 along an equal number of cabinet contact points 82, thereby preventing the tub 52 from moving relative to the cabinet 54. A tub contact point 80 and a cabinet contact point 82 lie along each of the six vertical edges 48.

II—Alternative Blank 110

Figure 6:
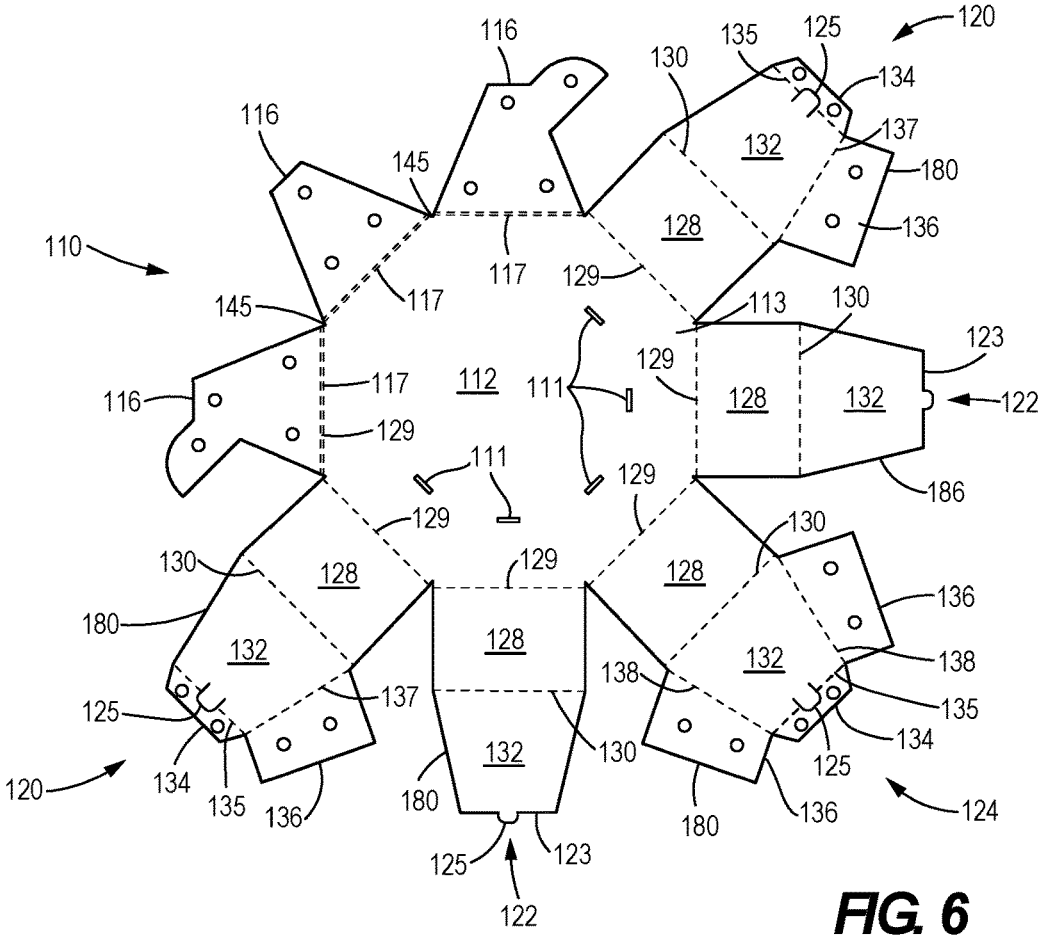
FIG. 6 is a top plan view of a blank for making an alternative tub support according to the present disclosure.

FIG. 6 is a top view of another embodiment of a unitary (one piece) blank 100 for making a tub support 140 that can be used to prevent a wash tub 52 from moving relative to a cabinet 54 during shipping and handling. The blank 110 is preferably made of corrugated board that is cut, folded and preferably glued into a three-dimensional shape that fits within the D-shaped top opening 66 of the wash tub 52 and contacts both the wash tub 52 and the cabinet 54 at multiple points to prevent the wash tub 52 from moving relative to the outer cabinet 54 during shipping and handling.

In the embodiment of FIG. 6, the blank 110 comprises a bottom panel 112 having an eight-sided perimeter 114, three bottom flaps 116 and five side flap assemblies 118. The five side flap assemblies 118 comprise two first side flaps 120, two second side flaps 122 and a single third side flap 124. The perimeter 114 comprises eight segments (defined by first fold lines 117 and second fold lines 129), two rear tub contact points 145 located on either side of the middle bottom flap 116 where the first fold lines 117 meet.

Each bottom flap 116 is foldably attached to the bottom panel 112 along a first fold line 117. Each bottom flap 116 may be any suitable shape, and may include a trapezoidal shaped main portion 119 and a lateral portion 121 extending from the main portion 119. This shape allows the bottom flaps 116 to be folded over onto the upper surface 113 (top facing surface) of the bottom panel 112 without overlapping, with each lateral portion 121 abutting a fastening tab 134 to help position and secure the bottom flaps 116.

Each of the five side flap assemblies 118 comprises, at a minimum, an outer panel 128 foldably attached to the bottom panel 112 along a corresponding second fold line 129. Each outer panel 128 may be any suitable shape, including rectangular shaped, for example having a distal edge or third fold line 130 that is parallel to the corresponding second fold line 129. Each side flap assembly 118 may further comprise an inner panel 132 rotatably connected to the outer panel 128 along the third fold line 130.

With respect to the two first side flaps 120 and the one third side flap 124, each may further comprise a bottom tab 134 extending from and foldably attached to the inner panel 132 by a fourth fold line 135. The bottom tab 134 is configured to adhere to the bottom panel 112 in the assembled tub support 140. Each first side flap 120 may further comprise a side tab 136 extending from a forward side fold line 137 for securing the first side flap 120 to an adjacent second side flap 122. Similarly, the third side flap 124 may further comprise two side tabs 136, one extending from each side fold line 138, for securing the third side flap 124 to two adjacent second side flaps 122.

With respect to the two second side flaps 122, each is positioned around the perimeter 114 between a first side flap 120 and the third side flap 124. Each second side flap 122 may comprise a free distal edge 123 parallel to a corresponding second fold line 129 and a corresponding third fold line 130.

It should be understood that the number, configuration and arrangement of the side flap assemblies 118 around the perimeter 114 can vary from that described above and still be in keeping with the scope and objective of this disclosure. For example, it is contemplated that the fastening tabs 134 could extend from the second side flaps 122 as well as or instead of the first and third side flaps 120, 124.

Each side flap assembly 118 may further comprise locking tab 125 extending from a corresponding inner panel 132. The bottom panel 112 may define a plurality of slots 111 arranged around the bottom panel 112 for receiving the locking tabs 125.

II—Alternative Tub Support 140

Figure 7:
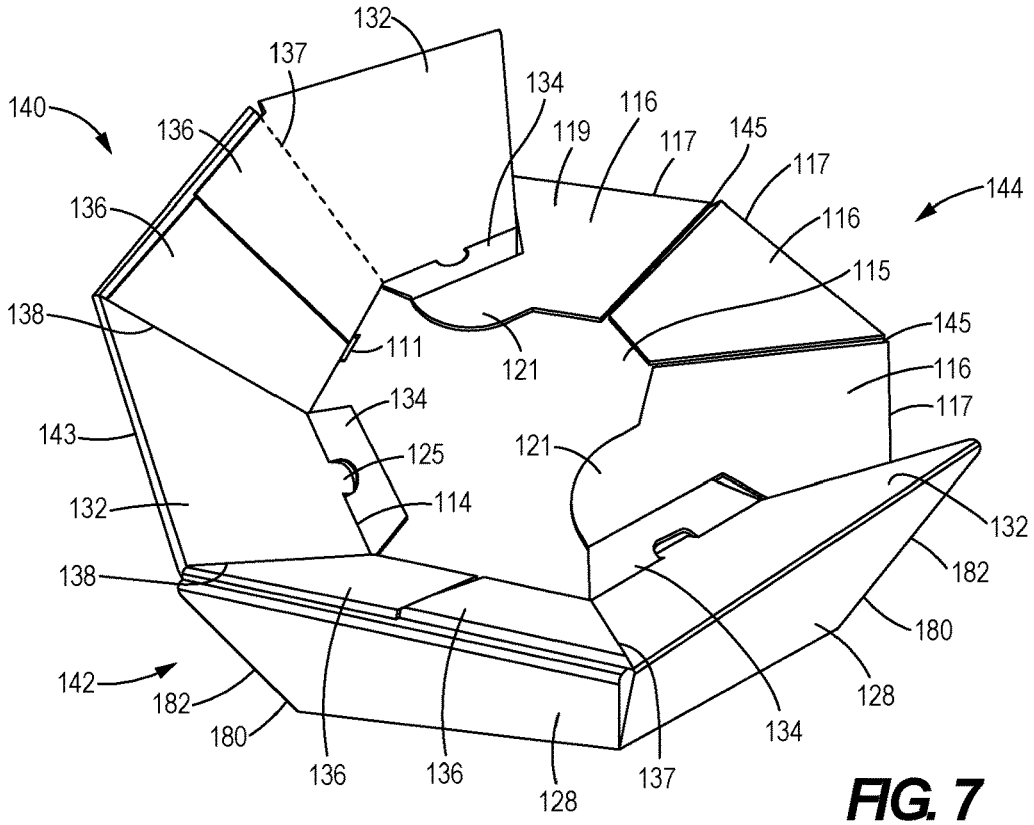
FIG. 7 is a top perspective view of an alternative tub support made from the blank of FIG. 6.

FIG. 7 is a perspective view of an assembled alternative tub support 140. The tub support 140 comprises a five-sided continuous sidewall 142 and a rear folded portion 144. The sidewall 142 is formed by the interconnected side flaps 120, 122, 124 and preferably extends between about 180 degrees and about 225 degrees around the bottom panel 112. The rear folded portion 144 is two layers thick and is formed by the three bottom flaps 116 and a rear portion 115 of the bottom panel 112 in flat facing abutment with the bottom flaps 116.

The eight-sided (octagonal) shape is considered optimal because this shape is best suited for holding the wash tub 52 stationary with respect to the cabinet 54 as explained below. Other configurations are contemplated, including six and seven sided shapes.

The tub support 140 comprises two rear tub contact points 145 where the first fold lines 117 meet. The tub support 140 also comprises six vertical edges 148 extending from the perimeter 114 of the bottom panel 112 to a five-part top edge 143 of the sidewall 142. The top edge 143 preferably has a top edge diameter greater than the front diameter (D1).

II—Method of Assembly

The tub support 140 may be assembled from a single blank 110 as follows.

Bottom Flaps 116

Fold or rotate each bottom flap 116 upwards/inwards 180 degrees about the first fold line 117 until the bottom flap 116 is in flat facing abutment with the upper surface 113 of the bottom panel 112. Preferably, apply adhesive to the bottom flap 116 and/or the bottom panel 112 before the rotation so that each bottom flap 116 is adhered to the bottom panel 112.

First Side Flaps 120

Fold or rotate each of the two first side flaps 120 upwards/inwards about 80 degrees or so about its corresponding second fold line 129 so that the first side flap 120 extends upwardly at an included angle (a) of about 110 degrees from the bottom panel 112. The included angle should be less than 120 degrees and preferably more than 90 degrees.

Fold or rotate each bottom tab 134 backward/outward, away from the center of the tub support 140 so that it is in position to contact the bottom panel 112 when the inner panel 132 is further rotated.

Fold or rotate each side tab 136 slightly backward (about 30-45 degrees) so that the side flap 134 is in position to be captured within and/or secured to an adjacent second side flap 122 when the inner panel 132 is further rotated.

Further rotate the inner panel 132 of each first side flap 120 about the third fold line 130 until the fourth fold line 135 contacts the bottom panel 112, the bottom tab 134 is in flat facing abutment with the bottom panel 112, and the locking tab 125 in inserted into a corresponding slot 111. The side tab 136 of each first side flap 120 should extend from the inner panel 132 at an angle that will allow the side tab 136 to be adhered to the adjacent second side flap 122 or captured between the inner panel 132 and the outer panel 128 of the adjacent second side flap 122.

After the inner panel 132 rotation step, the inner panel 132 and the outer panel 128 may be spaced apart to form a wedge shape. Alternatively, the inner panel 132 may be in flat facing abutment with the outer panel 128 to form a two-layer planar structure.

Third Side Flap 124

Similarly, fold or rotate the third side flap 124 about the second fold line 129 so that the third side flap 124 extends upwardly at an included angle of about 110 from the bottom panel 112. The included angle of rotation should be less than 120 degrees and preferably more than 90 degrees.

Fold or rotate the bottom tab 34 of the third side flap 24 backward/outward, away from the center of the tub support 40 so that it is in position to contact the bottom panel 12 when the inner panel 32 of the third side flap 24 is further rotated.

Fold or rotate both side tabs 136 slightly backward (about 30-45 degrees) so that each side flap 134 is in position to be secured to adhered to or captured within an adjacent second side flap 122 when the inner panel 132 is further rotated.

Further rotate the inner panel 132 of the third side flap 124 about the third fold line 130 until the fourth fold line 135 contacts the bottom panel 112, the locking tab 125 in inserted into a corresponding slot 111, and the bottom tab 134 is in flat facing abutment with the bottom panel 112 and preferably adhered thereto. Again, the inner panel 132 and the outer panel 128 may be spaced apart to form a wedge shape, or they may be in flat facing abutment with each other. The side tabs 136 extend from the inner panel 132 at an angle that will allow each side tab 36 to adhered to the inner panel 132 or captured between the inner panel 32 and the outer panel 28 of the adjacent second side flap 122.

Second Side Flaps 122

Next, rotate each of the two second side flaps 122 about its second fold line 129 so that the second side flap 122 extends upwardly at an included angle (a) of about 110 degrees or so from the bottom panel 112. Further rotate the inner panel 132 about the third fold line 130 until the free distal edge 123 contacts the bottom panel 112.

After this further rotation step, secure with adhesive or other means the side tab 136 from the adjacent first side flap 120 and the side tab 136 from the adjacent third side panel 124 to the inner facing surface of the inner panel 132 as shown in FIG. 7. Alternatively, the side tabs 136 of the adjacent side flaps 120, 124 may be captured between the inner panel 132 and the outer panel 128 of adjacent side assemblies 118.

In the assembled tub support 140, the side flaps 120, 122, 124 are interconnected to form a five-sided continuous sidewall 142 having six vertical edges 148, each vertical edge 148 incorporating a wash tub contact point 180 and a cabinet contact point 182. The six wash tub contact points 180 preferably are circumferentially disposed about the tub support 40 and lie within a first plane. Likewise, the six cabinet contact points 182 preferably are circumferentially disposed about the tub support 40 and lie within a second plane located above the first plane. The bottom flaps 116 and a rear portion 115 of the bottom panel 112 form a rear folded portion 144 that includes two rear tub contact points 145.

It should be understood that the order of the assembly steps can vary from that described above and still be in keeping with the scope and objective of this disclosure. For example, it is contemplated that the second side flaps 122 can be assembled before the first side flaps 120 and/or third side flap 124.

II—Installation

The tub support 140 may be installed as follows.

Figure 8:
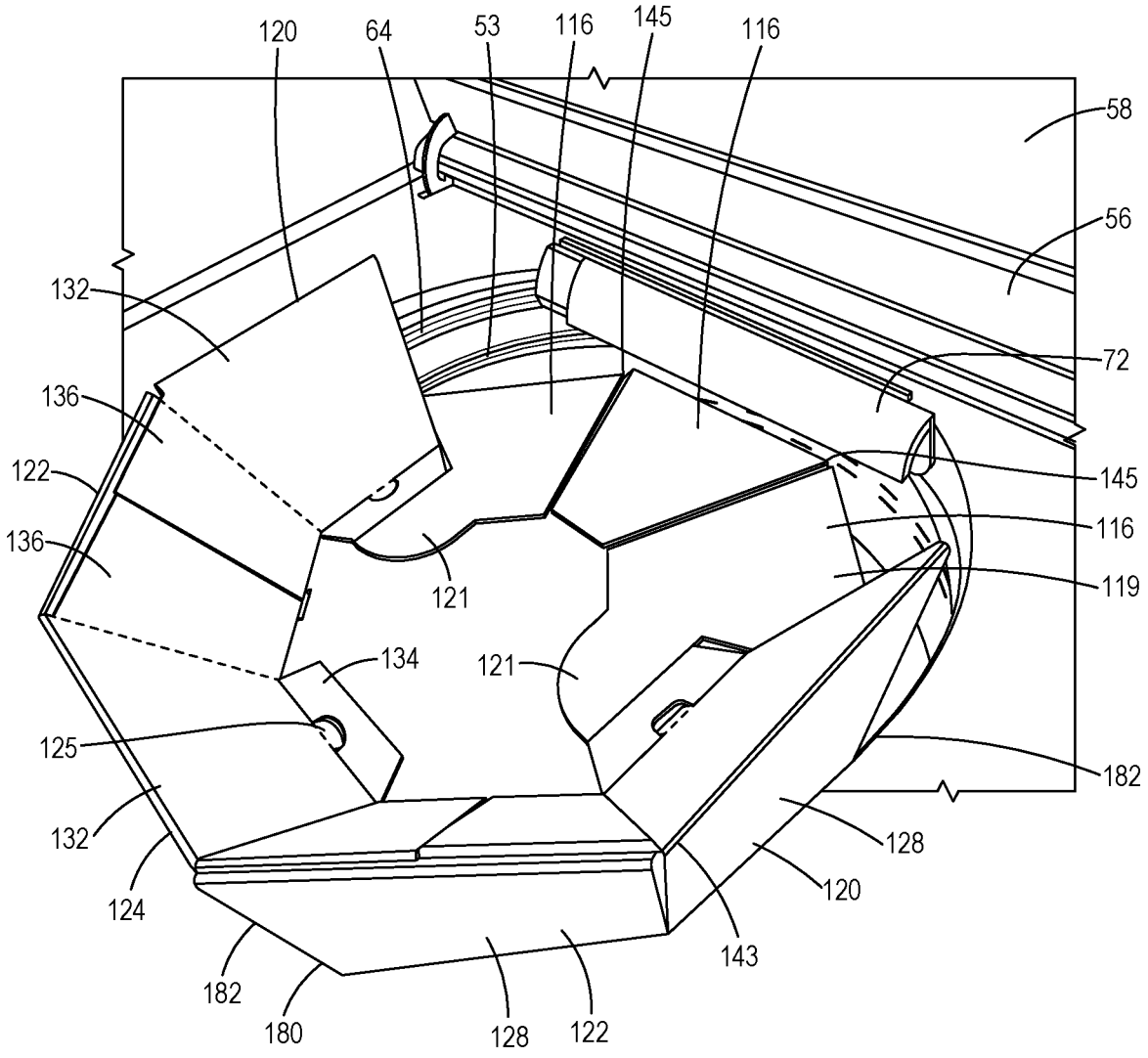
FIG. 8 is a top perspective view of the tub support of FIG. 7 partially installed in a washing machine.

As shown in FIG. 8, lower or insert the assembled tub support 140 into the top opening 66 of a washing machine 50 so that the rear folded portion 144 extends toward the rear of the top opening 66.

Optionally, tilt the tub support 140 so that the rear folded portion 144 can be inserted under the rear of the top opening 66 and/or any reservoir 72.

Further insert the tub support 140 into the top opening 66 until the tub support 140 engages both the rim 64 and the wash tub 52. The tub support 140 should be inserted far enough into the top opening 66 of the washing machine 50 so that the lid 56 can be completely closed.

In the installed position, the tub support 140 should contact both the wash tub 52 and the cabinet 54 at multiple points to prevent the wash tub 52 from moving relative to the outer cabinet 54 during shipping and handling. More specifically, the two rear tub contact points 145 and the six wash tub contact points 180 should contact the wash tub 52 while the six cabinet contact points 182 should contact the cabinet rim 64.

II—Industrial Applicability

Figure 9:
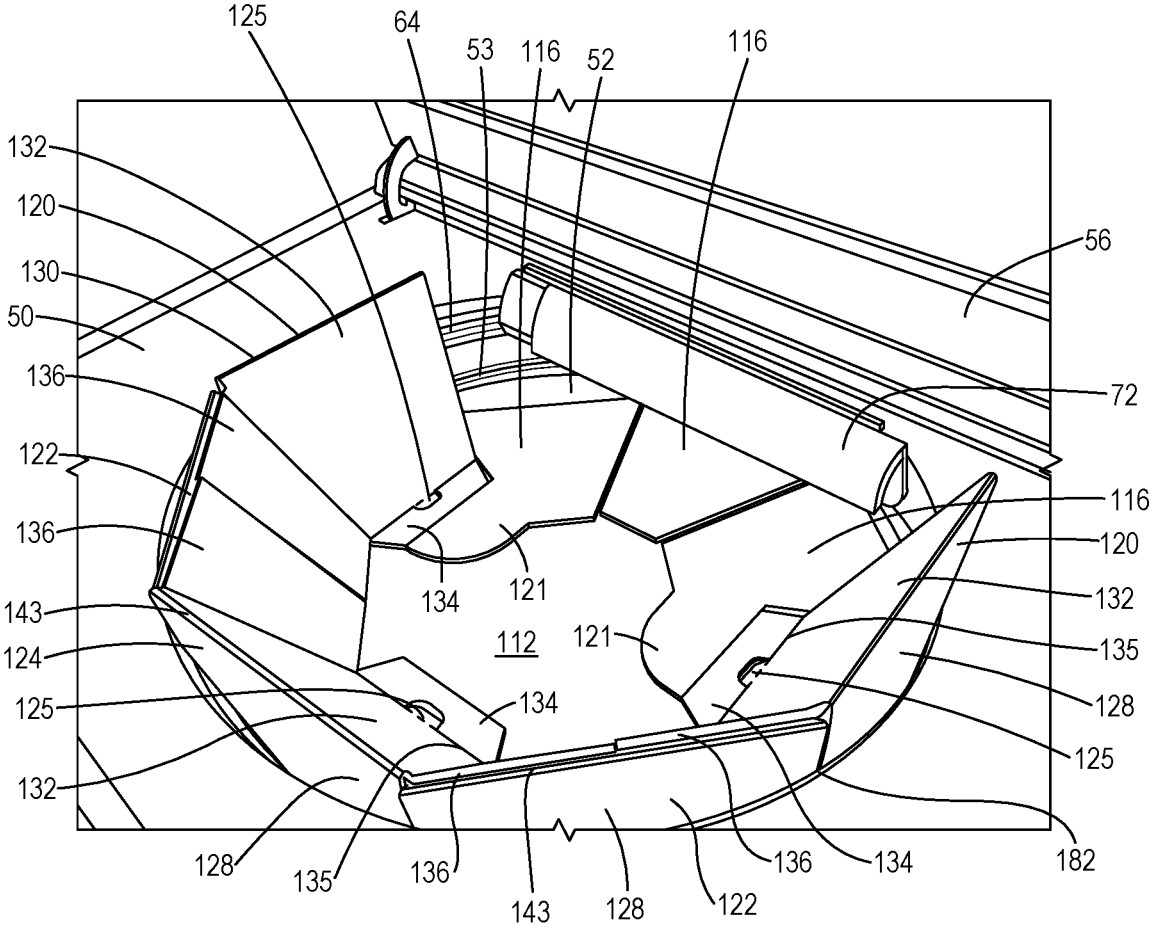
FIG. 9 is a top perspective view of the tub support of FIG. 7 installed in a washing machine.

FIG. 9 is a top perspective view of the tub support 140 of FIG. 7 fully installed in a washing machine 50.

In this fully installed configuration, the rear folded portion 144 of the tub support 140 extends at least partially under the straight rear portion of the rim 64—if there is one—and/or the reservoir 72. The rear folded portion 144, and thus the tub support 140, contacts the interior wall 74 of the wash tub 52 at the two rear tub contact points 145.

The five-sided continuous sidewall 142 extends from below the top edge 53 of the wash tub 52 to above the semicircular front portion 68 of the rim 64. A tub contact point 180 and a cabinet contact point 182 lie along each of the six vertical edges 48. The sidewall 142 contacts the top edge 53 of the wash tub 52 along six tub contact points 180 (obscured in FIG. 9) and also contacts the rim 64 of the cabinet 54 along an equal number of cabinet contact points 182, thereby preventing the tub 52 from moving relative to the cabinet 54.

It should be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A tub support for use with a washing machine of a type having a wash tub located within a cabinet, the wash tub having a top edge, the cabinet having a top surface having a rim defining a top opening, the rim comprising a semicircular front portion and a rear portion, the top opening having a width, the tub support made from a single, folded blank, the tub support comprising:

a bottom panel having a perimeter, the bottom panel comprising a rear portion;

a continuous sidewall extending upward from the bottom panel and above the semicircular front portion of the rim, the sidewall configured to contact both the wash tub and the cabinet; and a rear folded portion comprising a plurality of bottom flaps foldably attached to and in flat facing abutment with the rear portion, the rear folded portion being configured to extend under the rear portion of the rim.

2. The tub support of claim 1 wherein:

the rear folded portion comprises two rear tub contact points that contact the wash tub; and the sidewall is configured to contact the top edge of the wash tub along a plurality of tub contact points and to contact the rim of the cabinet along a plurality of cabinet contact points.

3. The tub support of claim 2, wherein:

the sidewall comprises six vertical edges extending from the perimeter to a top edge of the sidewall; and a tub contact point and a cabinet contact point lie along each of the six vertical edges.

4. The tub support of claim 3, wherein:

the sidewall is five-sided and comprises two first side flaps, two second side flaps and one third side flap;

each second side flap is positioned around the perimeter between a first side flap and the third side flap;

each first side flap comprises an outer panel foldably attached to the bottom panel along a second fold line, an inner panel rotatably connected to the outer panel along a third fold line and a side tab extending from the inner panel and adapted to secure the first side flap to an adjacent second side flap;

each second side flap comprises an outer panel foldably attached to the bottom panel along a second fold line, an inner panel rotatably connected to the outer panel along a third fold line; and the third side flap comprises an outer panel foldably attached to the bottom panel along a second fold line, an inner panel rotatably connected to the outer panel along a third fold line, and a side tab extending from opposite side fold lines of the inner panel, each side tab adapted to secure the third side flap to an adjacent second side flap.

5. The tub support of claim 4, wherein:

each of the first side flaps, each of the second side flaps and the third side flap extends upwardly from the bottom panel at an included angle of between 90 degrees and 120 degrees.

6. The tub support of claim 4, wherein:

each of the first side flaps, second side flaps and third side flap extends upwardly from the bottom panel at an included angle of greater than 90 degrees.

7. A tub support for use with a washing machine of a type having a wash tub located within a cabinet, the wash tub having a top edge, the cabinet having a top surface having a rim defining a top opening, the rim comprising a semicircular front portion and a rear portion, the top opening having a width, the tub support made from a single, folded blank comprising:

a bottom panel having a perimeter, the bottom panel comprising a rear portion;

a continuous sidewall formed by interconnected side flaps and extending around part of the perimeter, the sidewall extending upward and outward from the bottom panel at an included angle of greater than 90 degrees, the sidewall configured to contact both the top edge and the semicircular front portion; and a rear folded portion comprising a plurality of bottom flaps and a rear portion of the bottom panel, the bottom flaps in flat facing abutment with the rear portion, the rear folded portion being configured to extend under the rear portion of the rim.

8. The tub support of claim 7 wherein:

the rear folded portion comprises two rear tub contact points that contact the wash tub; and the sidewall is configured to contact the top edge of the wash tub along a plurality of tub contact points and to contact the rim of the cabinet along a plurality of cabinet contact points.

9. The tub support of claim 8, wherein:

the sidewall comprises a plurality of vertical edges extending from the perimeter to a top edge of the sidewall; and a tub contact point and a cabinet contact point lie along each of the vertical edges.

10. The tub support of claim 9, wherein:

the sidewall comprises two first side flaps, two second side flaps and one third side flap;

each second side flap is positioned around the perimeter between a first side flap and the third side flap;

each first side flap comprises an outer panel foldably attached to the bottom panel along a second fold line, an inner panel rotatably connected to the outer panel along a third fold line, and a side tab extending from the inner panel and adapted to secure the first side flap to an adjacent second side flap;

each second side flap comprises an outer panel foldably attached to the bottom panel along a second fold line, an inner panel rotatably connected to the outer panel along a third fold line; and the third side flap comprises an outer panel foldably attached to the bottom panel along a second fold line, an inner panel rotatably connected to the outer panel along a third fold line, and a side tab extending from opposite side fold lines of the inner panel, each side tab adapted to secure the third side flap to an adjacent second side flap.

11. The tub support of claim 10, wherein:

each of the first side flaps, each of the second side flaps and the third side flap extend upwardly from the bottom panel at an included angle of greater than 90 degrees.

12. The tub support of claim 11, wherein:

each of the two first side flaps and the third side flap further comprises a bottom tab extending from and foldably attached to the inner panel by a fourth fold line, each bottom tab being in flat facing abutment with the bottom panel; and each bottom flap is foldably attached to the bottom panel along a first fold line and comprises a trapezoidal shaped main portion and a lateral portion extending from the main portion, each lateral portion abutting a bottom tab.

13. The tub support of claim 12, wherein:

each of the first side flaps, each of the second side flaps and the third side flap further comprises a locking tab extending from the inner panel and inserted into a corresponding slot defined by the bottom panel.

14. The tub support of claim 12, wherein:

each bottom flap is adhered to the bottom panel; and each bottom tab is adhered to the bottom panel.

15. The tub support of claim 7, wherein:

the washing machine top opening is D-shaped and the rear portion is straight;

the front portion has a front diameter (D1);

the perimeter has a perimeter diameter less than the front diameter (D1); and the sidewall has a top edge having a top edge diameter greater than the front diameter (D1).

* * * * *